US007829843B2

(12) United States Patent
Burnin et al.

(10) Patent No.: US 7,829,843 B2
(45) Date of Patent: Nov. 9, 2010

(54) ELECTRONIC TIME-OF-FLIGHT MASS SELECTOR

(75) Inventors: Andrei Burnin, West Lebanon, NH (US); Joseph J. Belbruno, Hanover, NH (US)

(73) Assignee: The Trustees of Dartmouth College, Hanover, NH (US)

( * ) Notice: Subject to any disclaimer, the term of this patent is extended or adjusted under 35 U.S.C. 154(b) by 310 days.

(21) Appl. No.: 11/571,860

(22) PCT Filed: Jun. 22, 2005

(86) PCT No.: PCT/US2005/022199

§ 371 (c)(1),
(2), (4) Date: Oct. 21, 2008

(87) PCT Pub. No.: WO2006/016986

PCT Pub. Date: Feb. 16, 2006

(65) Prior Publication Data

US 2009/0050800 A1 Feb. 26, 2009

Related U.S. Application Data

(60) Provisional application No. 60/586,776, filed on Jul. 9, 2004.

(51) Int. Cl.
*H01J 49/00* (2006.01)

(52) U.S. Cl. ..... 250/287; 250/281; 250/282; 250/288

(58) Field of Classification Search ..... 250/281, 250/282, 287, 288
See application file for complete search history.

(56) References Cited

U.S. PATENT DOCUMENTS

| | | | | |
|---|---|---|---|---|
| 4,694,167 | A * | 9/1987 | Payne et al. | 250/282 |
| 5,654,543 | A * | 8/1997 | Li | 250/287 |
| 2003/0020014 | A1 * | 1/2003 | Zimmermann et al. | 250/288 |

OTHER PUBLICATIONS

PCT/US2005/022199, Written Opinion, Sep. 21, 2005, 5 pages.

* cited by examiner

*Primary Examiner*—Jack I Berman
*Assistant Examiner*—Meenakshi S Sahu
(74) *Attorney, Agent, or Firm*—Lathrop & Gage LLP

(57) ABSTRACT

A method of selecting ions includes generating a group of ions, accelerating the group of ions through a flight region towards an electronic mass selector grid, and selectively varying a voltage applied to the electronic mass selector grid, such that only a selected subset of the group of ions passes through the grid. An apparatus for selecting ions includes an ion generator, an ion accelerator for accelerating ions into a flight region, and an electronic mass selector grid responsive to an applied voltage to pass a subset of the ions from the flight region. An apparatus for detecting a threat molecule includes an ion generator for generating ions from a mixed gas stream, an ion accelerator for accelerating the ions into a flight region, and an electronic mass selector grid. The grid passes only a subset of the ions, such as ions and/or ionized fragments of the threat molecule.

21 Claims, 8 Drawing Sheets

ELECTRONIC TIME-OF-FLIGHT MASS SELECTOR

CROSS-REFERENCE TO RELATED APPLICATIONS

This application claims the benefit of priority to U.S. Provisional Patent Application No. 60/586,776, filed 9 Jul. 2004 and incorporated herein by reference.

BACKGROUND

Certain devices identify and/or isolate specific atomic elements or molecules using physical mechanisms to distinguish the elements or molecules of interest. For example, magnetic sector mass analyzers and quadrupole mass analyzers use magnetic fields and electric fields, respectively, to manipulate flight paths of accelerated ions based on the ions' charge-to-mass ratio. The magnetic sector mass analyzer uses a magnetic field, typically generated by a large magnet, to bend an ion beam through a curved trajectory. The radius of curvature depends on the charge-to-mass ratio of the ions, so a component stream containing ions of various masses spreads into a band that may be analyzed to determine the identity of the ions (e.g., as part of a mass spectrometer) and/or filtered to generate a beam of ions of a specific mass (e.g., as an ion filter for ion implantation). The quadrupole mass analyzer applies an oscillating electric field to an ion beam, allowing only ions of a specific charge-to-mass ratio to pass in a straight line, sending all other ions into chaotic paths. As a result, the quadrupole mass analyzer inherently acts as a filter, selecting ions of a single mass.

A time-of-flight mass spectrometer uses time, rather than space, to separate ions. The time-of-flight mass spectrometer generates a cloud of ions and accelerates the ions into spatially identical flight paths in a field-free drift region, wherein each ion's time of flight is dependent on the charge-to-mass ratio of the ion. Since all ions are generated in one region and accelerated simultaneously, an initial ion cloud separates into subsets: the lightest ions travel faster and arrive at the end of the field-free drift region sooner as compared to heavier ions. By measuring the flight times of ion subsets arriving at an ion detector, the time-of-flight mass spectrometer determines the masses of the detected ions. The time of flight method for distinguishing among ions does not utilize magnetic fields, and resolves masses of heavier ions than can be resolved by magnetic sector or quadrupole mass analyzers.

SUMMARY

In one embodiment, a method of selecting ions includes generating a group of ions and accelerating the group of ions through a flight region towards an electronic mass selector grid. A voltage applied to the electronic mass selector grid selectively varies, such that only a selected subset of the group of ions passes through the electronic mass selector grid.

In one embodiment, an apparatus for selecting ions includes an ion generator an ion accelerator for accelerating ions into a flight region. An electronic mass selector grid is responsive to an applied voltage to pass a subset of the ions from the flight region.

In one embodiment, an apparatus for detecting a threat molecule includes an ion generator for generating ions from a mixed gas stream, an ion accelerator for accelerating the ions into a flight region, and an electronic mass selector grid. The grid passes only a subset of the ions, such as ions and/or ionized fragments of the threat molecule.

The following descriptions and drawings use positive ions for illustrative purposes. Voltage polarity changes make operation for negative ions also possible.

DETAILED DESCRIPTION OF DRAWINGS

Figure 1:
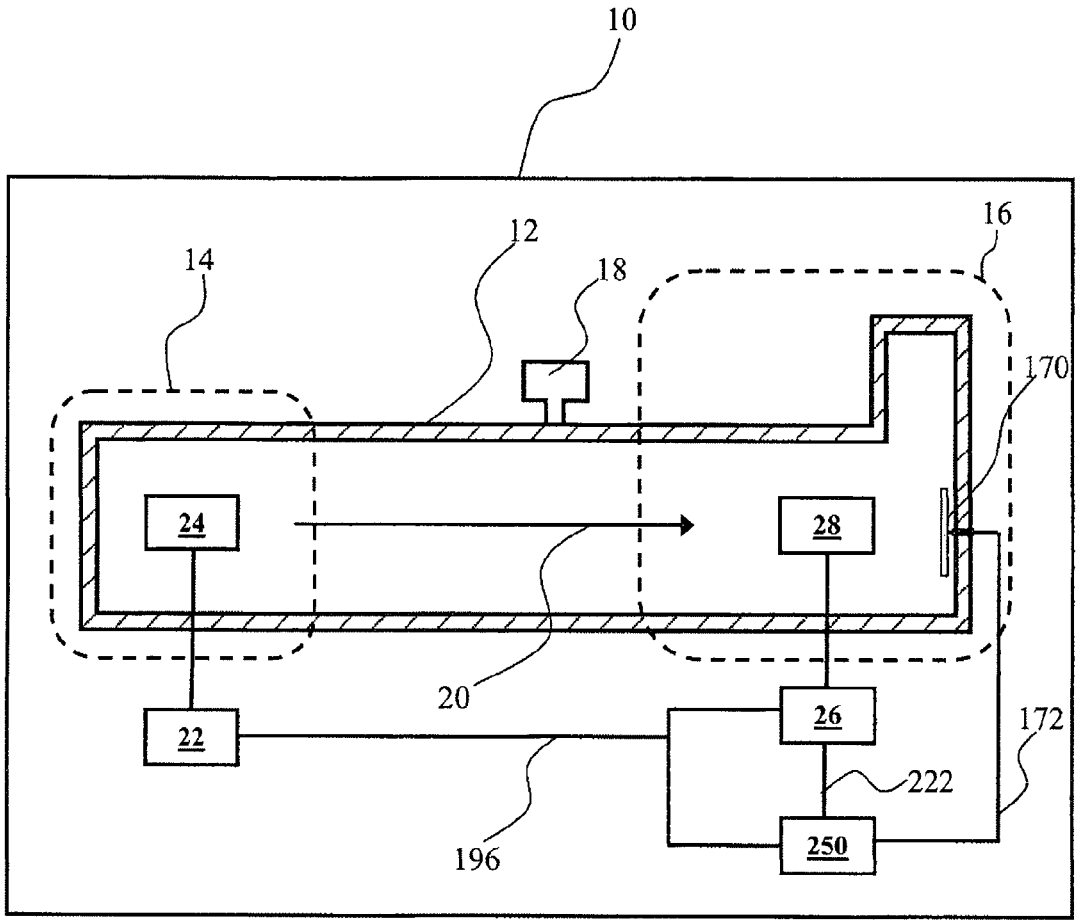
FIG. 1 shows one electronic time-of-flight mass selector within a time-of-flight mass spectrometer.

FIG. 1 shows one time-of-flight mass spectrometer ("TOF-MS") 10 with an electronic time-of-flight mass selector ("EMS") that includes EMS gate electronics 26 and EMS in-vacuum components 28. TOF-MS 10 includes a vacuum chamber 12 that may be evacuated by a vacuum pump 18. An ion generator 14 and a detector end 16 are shown with vacuum chamber 12. In operation, ion generator 14 generates ions (not shown) that travel in the direction of arrow 20 to detector end 16. Ion acceleration electronics 22 connect with ion acceleration components 24 within ion generator 14, as shown, to accelerate the ions. Detector end 16 includes an ion detector 170.

TOF-MS 10 may include a two-channel oscilloscope 250 to display and/or analyze data from TOF-MS 10. Ion generation electronics 22 connect with oscilloscope 250 via a signal line 196; EMS gate electronics 26 connect with oscilloscope 250 via a signal line 222; and ion detector 170 connects with oscilloscope 250 via a detector output 172. EMS gate electronics 26 connect with ion generation electronics 22 via signal line 196, as shown.

Figure 2:
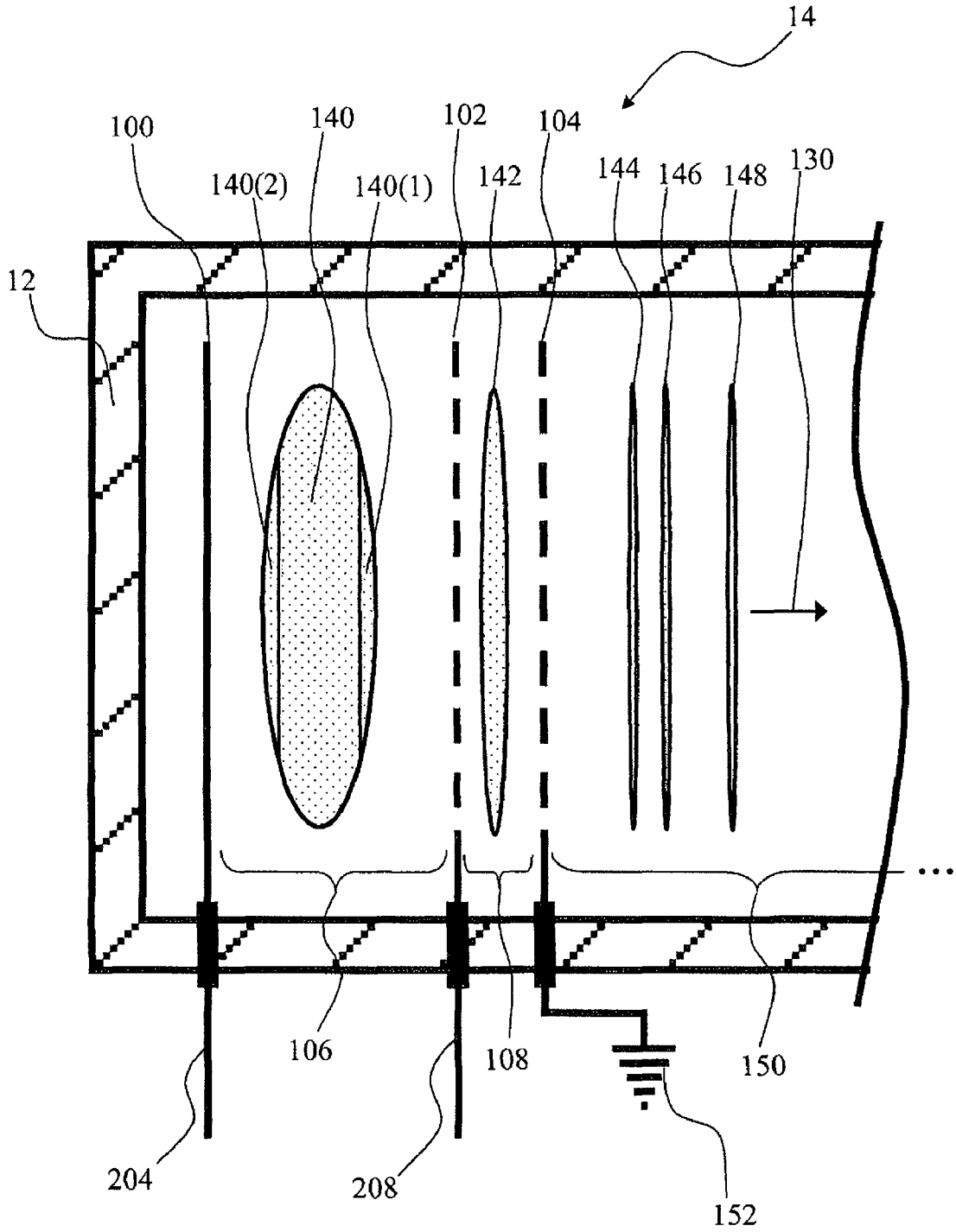
FIG. 2 shows exemplary detail of a portion of one ion generator of the time-of-flight mass spectrometer of FIG. 1.

FIG. 2 shows exemplary detail of ion generator 14 to better illustrate components 24, including a backing plate 100, an extraction grid 102, and an acceleration grid 104. Between backing plate 100 and extraction grid 102 is an ion generation region 106. Between extraction grid 102 and acceleration grid 104 is an acceleration region 108. From acceleration grid 104, in the direction of arrow 130, is a field-free drift region 150. Backing plate 100 connects with a high voltage line 204; extraction grid 102 connects with a high voltage line 208; and acceleration grid 104 connects with a ground 152. These connections may be made through, and insulated from, vacuum chamber 12.

During operation of ion generator 14, a group of ions 140 is formed within region 106 by, for example, a Q-switched laser (not shown). After a delay, and at a time called herein an "acceleration time," high voltage lines 204 and 208 are raised to voltages HV1 and HV2, respectively. Voltage HV1 is greater than voltage HV2, causing ions 140 in region 106 to move in the direction of arrow 130. As ions 140 pass through extraction grid 102 into acceleration region 108 they become ions 142, as shown. Voltage HV2 is higher than ground, which further accelerates ions 142 in region 108 in the direction of arrow 130. Region 150 is free of electric (and magnetic) fields. As ions 142 pass through acceleration grid 104 and enter drift region 150, each ion, having accelerated through about the same voltage difference, has about the same kinetic energy $E_k$. However, individual ions may have different masses, so the velocity of each ion within drift region 150 will differ according to its mass (according to the equation $E_k$=mass*(velocity)$^2$/2). The differing velocities of the ions spread the ions into subsets within drift region 150, for example subsets 144, 146 and 148, as shown. All ions within a given subset have identical masses, but the masses of ions in each subset are different from the masses of ions in the other subsets. For example, ion subset 148 has ions of lower mass and travels fastest; subset 146 has ions of intermediate mass and travels slower; subset 144 has ions of high mass and travels slowest. The three subsets 144, 146, and 148 are illustrative only; the separation of ions into subsets in drift region 150 is not limited to any particular number of subsets.

Figure 3:
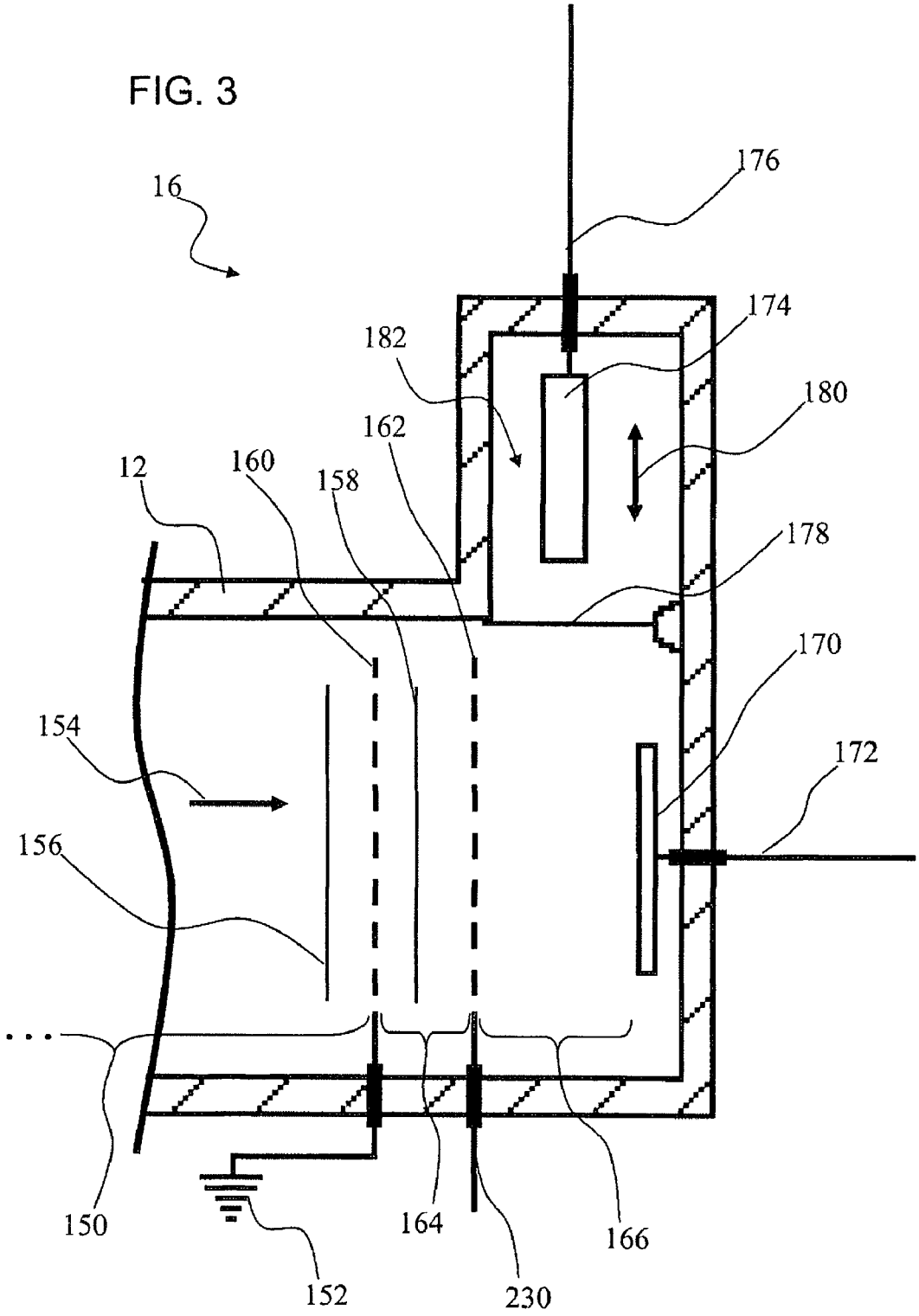
FIG. 3 shows exemplary detail of one detector end of the electronic time-of-flight mass selector and time-of-flight mass spectrometer of FIG. 1.

FIG. 3 shows exemplary detail of detector end 16 of TOF-MS 10, to illustrate EMS in-vacuum components 28, including a ground grid 160 and an EMS grid 162, which connect with ground 152 and a high voltage line 230, respectively. Ion detector 170 connects with detector output 172; as before, connections are made through and insulated from vacuum chamber 12. FIG. 3 shows a continuation of drift region 150 from FIG. 2. Between ground grid 160 and EMS grid 162 is a region 164. Between EMS grid 162 and ion detector 170 is a region 166.

A substrate holder 176 mounts with a wall of vacuum chamber 12. Substrate holder 176 positions a substrate 174 either within region 166, or a region 182 of detector end 16, as shown (i.e., substrate holder 176 can move in the directions indicated by arrow 180). When substrate holder 176 is within region 182, closing gate valve 178 isolates region 182 from region 166. Region 182 may operate as a load lock. For example, vacuum chamber 12 may include a port (not shown) that opens region 182 for loading substrates to and from substrate holder 176, while the rest of vacuum chamber 12 remains under vacuum (isolated by gate valve 178). Region 182 of vacuum chamber 12 may also include connections to a vacuum pump (not shown), to restore vacuum to region 182 after venting for substrate loading.

During operation of detector end 16, subsets of ions (e.g., subsets 144, 146, and 148 of FIG. 2) are generated, accelerated (e.g., by ion generator 14) at the acceleration time into drift region 150, and enter detector end 16. For example, a subset of ions 156 enters detector end 16 moving in the direction shown by arrow 154. As subset 156 passes through ground grid 160, it becomes subset 158 within region 164. When a high voltage HV3 is applied to high voltage line 230 and EMS grid 162, subset 158 turns back before reaching EMS grid 162. A vacuum pump (not shown) removes ions of subset 158 that turn back from vacuum chamber 12. However, the voltage applied to high voltage line 230 and EMS grid 162 may be reduced to ground at one or more times coinciding with the arrival of a subset 158 having ions of a specific mass, at EMS grid 162. When high voltage line 230 and EMS grid 162 are grounded, regions 164 and 166 become field-free regions (like drift region 150) and ions of a subset 158 in these regions keep moving until striking ion detector 170 or substrate 174 (if positioned within region 166). Thus, selectively varying the voltage on high EMS grid 162 alternately allows one or more selected subsets of ions to pass through grid 162 (when grid 162 is grounded) and rejects nonselected subsets of ions (when grid 162 is at HV3).

Figure 4:
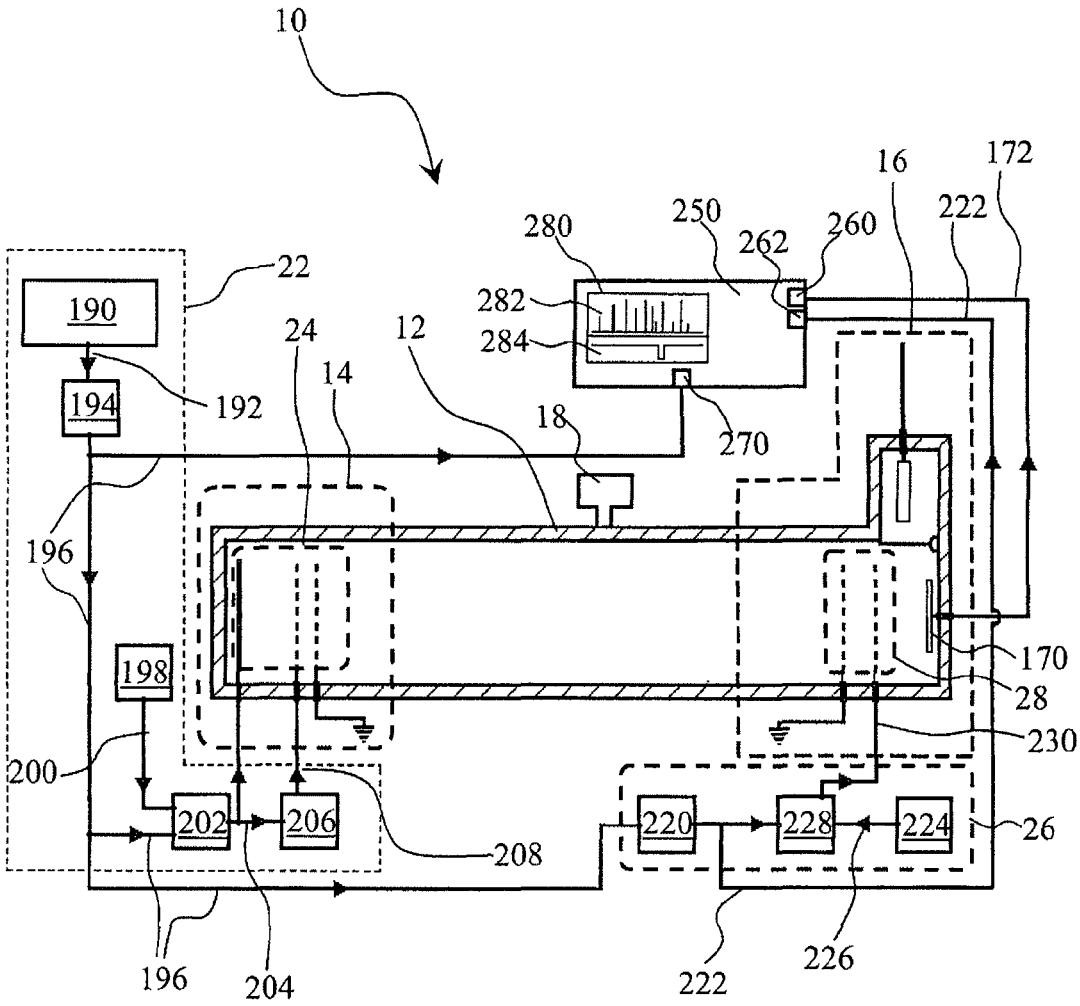
FIG. 4 shows exemplary detail of the electronic time-of-flight mass selector and time-of-flight mass spectrometer of FIG. 1.

FIG. 4 shows exemplary detail of a TOF-MS 10 incorporating ion generator 14 of FIG. 2 and detector end 16 of FIG. 3. Vacuum chamber 12, including ion generator 14 and detector end 16, is also shown. Numerals are omitted from the components within ion generator 14 and detector end 16 for clarity of illustration within FIG. 4; the following discussion refers to components and ion subsets within these ends by the numerals used in FIG. 2 and FIG. 3.

Figure 5:
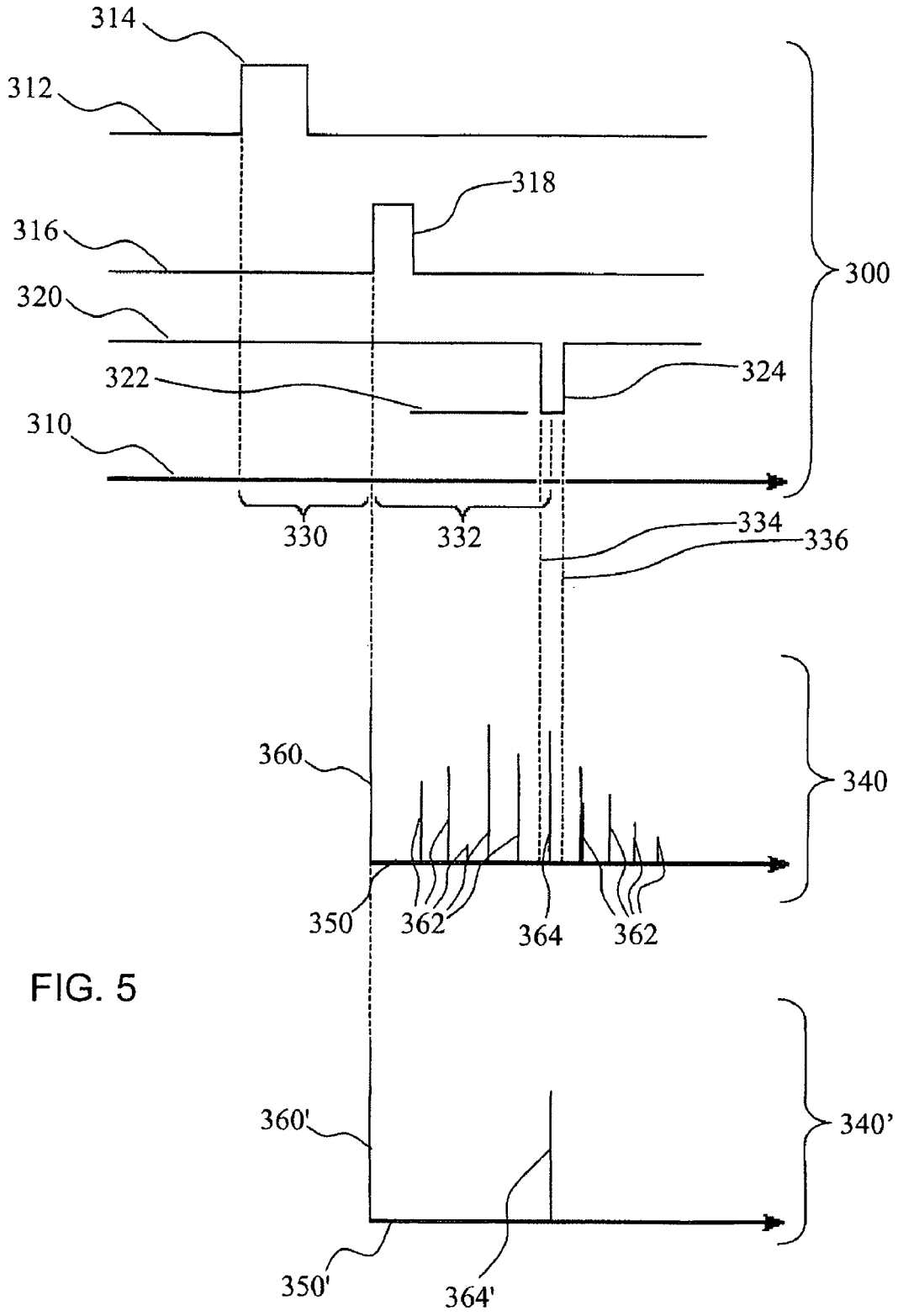
FIG. 5 shows a timing diagram and two exemplary oscilloscope displays demonstrating operation of the electronic time-of-flight mass selector of FIG. 1.
Figure 6:
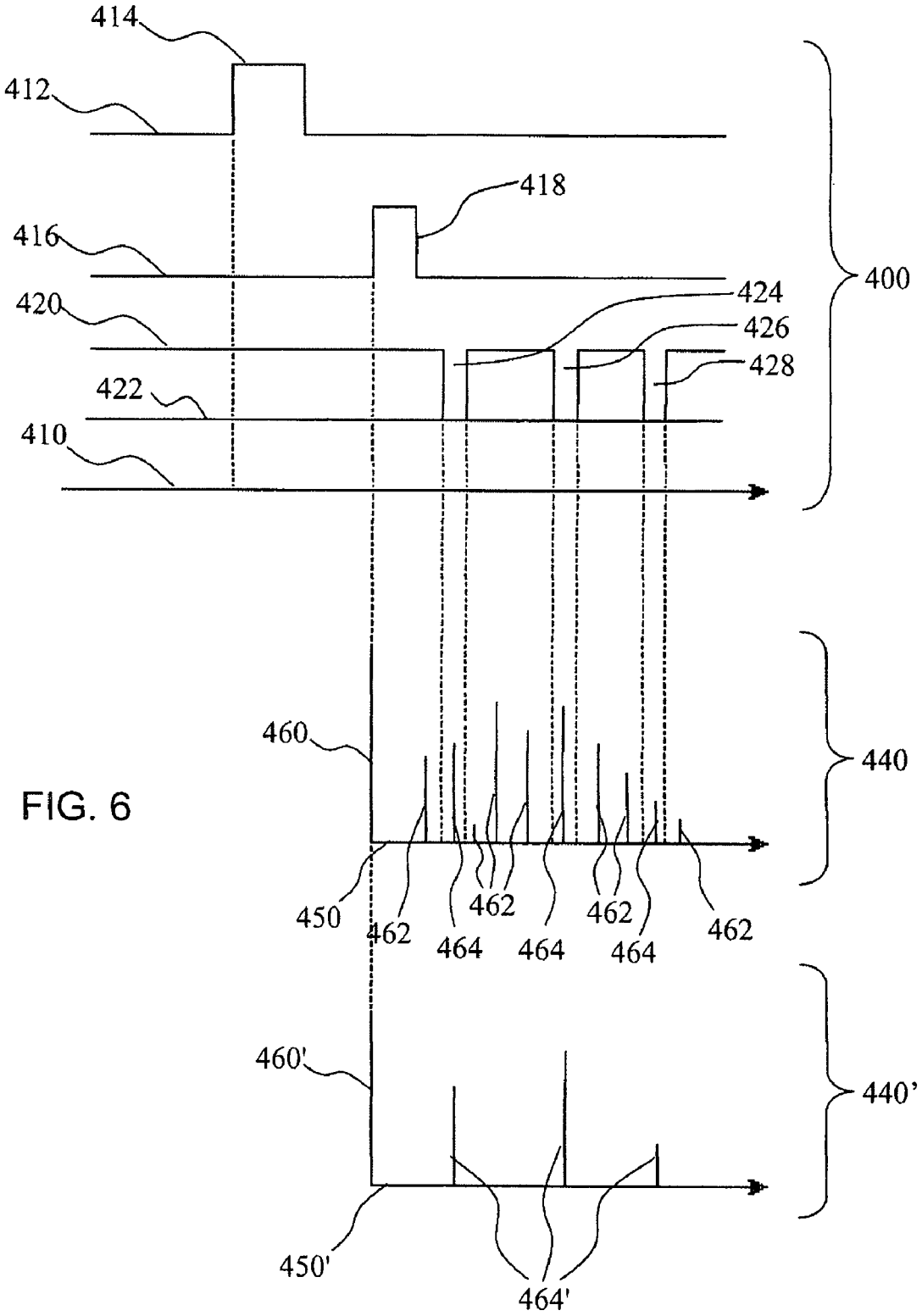
FIG. 6 shows a timing diagram and two exemplary oscilloscope displays demonstrating operation of another electronic time-of-flight mass selector.

A laser power supply 190 provides power to a Q-switched laser (not shown) which generates ions 140 within region 106 of FIG. 2. A first trigger pulse from the output of laser power supply 190 connects with a signal line 192. A leading edge of the first trigger pulse in signal line 192 triggers a delay generator 194, which after a delay sends a second trigger pulse into signal line 196 (exemplary timing diagrams are shown in FIG. 5 and FIG. 6). A leading edge of the second trigger pulse corresponds to the acceleration time, which serves as a time reference for all subsequent events and corresponds to zero on a time of flight scale. Signal line 196 connects with a trigger input 270 of two-channel oscilloscope 250, a high-voltage timing circuit 202 and another delay generator 220, as shown. A high voltage power supply 198 applies high voltage HV1 to a high voltage line 200 which connects with a high-voltage timing circuit 202. In response to the leading edge of the second trigger pulse in signal line 196, high-voltage timing circuit 202 connects high voltage line 200 with a high voltage line 204 for a short time (e.g., about 5 microseconds or less). High voltage line 204 connects with a potentiometer 206, which applies an output voltage HV2 to a high voltage line 208.

Backing plate 100, extraction grid 102 and acceleration grid 104 act as a dual stage accelerator. For example, when voltages HV1 and HV2 are applied to backing plate 100 and extraction grid 102 respectively, all ions within region 106 accelerate towards extraction grid 102, driven by a voltage difference HV1−HV2. Upon passing through extraction grid 102, ions 142 then accelerate towards acceleration grid 104, driven by voltage HV2 over the space of region 108. Passing through acceleration grid 104, ions (e.g., subsets 144, 146, and 148) enter drift region 150.

Referring to FIG. 2 and FIG. 4, a first set of ions 140(1), within group 140 but closer to extraction grid 102 than other ions within group 140 when high-voltage timing circuit 202 is triggered, initially forms the leading edge of ion group 140. Due to closeness to extraction grid 102 at the acceleration time, ions 140(1) are not accelerated through the full voltage difference HV1−HV2. A second set of ions 140(2) that are closer to backing plate 100 when high-voltage timing circuit 202 is triggered initially forms the trailing edge of ion group 140, but are accelerated through a greater portion of voltage difference HV1−HV2 than ions 140(1). In a sufficiently long drift region 150, ions 140(2) overtake and pass ions 140(1). Differences in initial position and acceleration voltage (as exemplified by ions 140(1) and 140(2)) cause variation in the time spent by ions of single subsets within drift region 150, so that ions of each subset (e.g., ions of identical mass) arrive at ion detector 170 over a time span, instead of arriving at the same time. To decrease the time span of each ion subset's arrival, potentiometer 206 adjusts voltage HV2 to a suitable fraction of HV1, to space-focus the ion subsets. Detector output 172 connects with one channel input 260 of two-channel oscilloscope 250. A channel display 282 of oscilloscope display 280 shows peaks that correspond to ion subsets arriving at ion detector 170. From display 282, an operator of TOF-MS 10 may observe (1) the times of flight, relative to the acceleration time; (2) the relative number of ions in each detected ion subset, indicated by the height of each peak; and (3) the span of ion arrival times within each subset, indicated by the width of each peak. Using this information, the operator of TOF-MS 10 may adjust potentiometer 206 until the peaks are as narrow as possible.

EMS gate electronics 26 include a delay generator 220, signal line 222, a high voltage power supply 224, a high voltage line 226, a high-voltage timing circuit 228 and a high voltage line 230, as shown in FIG. 3. EMS vacuum components include a ground grid 160 and an EMS grid 162 as shown in FIG. 3. The leading edge of the second trigger pulse, in signal line 196, triggers delay generator 220 so that after a delay, it sends a third trigger pulse on signal line 222. Signal line 222 connects with a channel input 262 of two-channel oscilloscope 250, and with high-voltage timing circuit 228. High voltage power supply 224 applies high voltage HV3 to high voltage line 226, which also connects with high-voltage timing circuit 228. High-voltage timing circuit 228 normally connects high voltage line 230 with high voltage line 226, but in response to the leading edge of the third trigger pulse in signal line 222, high-voltage timing circuit 228 connects high voltage line 230 with ground for a designated time period. The time at which high voltage line 230 first connects to ground is adjustable through controls on delay generator 220; and the duration of the colmection to ground is adjustable through controls on high-voltage timing circuit 228. Since signal line 222 connects with channel input 262, a channel display 284 of oscilloscope display 280 shows the delay of the third trigger pulse with respect to the second trigger pulse, and the duration of the third trigger pulse (see FIG. 5). The operator of TOF-MS 10 may therefore use the information available on display 280 of two-channel oscilloscope 250 as guidance while adjusting the third trigger pulse delay and duration to coincide with the arrival time and duration of a selected ion subset. Delay generator 220 may be disabled during setup of TOF-MS 10 (i.e., it may set high voltage line 230 to ground voltage, allowing all ion subsets to pass through EMS grid 162 for detection by ion detector 170). When setup is complete, delay generator 220 may be enabled to begin selection of ion subsets.

By generating groups of ions, sorting the ions into subsets by time of flight (and thus by mass), and selecting specific ions from these subsets through the action of voltages applied to EMS grid 162, a source of identical-mass ions may be provided for deposition on substrates.

FIG. 5 shows a timing diagram 300 and two oscilloscope displays 340 and 340' demonstrating operation of TOF-MS 10. Display 340 corresponds to channel display 282 of FIG. 4, illustrating a time interval with electronic mass selection disabled (i.e., with delay generator 220 of FIG. 4 disabled). Display 340' corresponds to channel display 282 illustrating a time interval with electronic mass selection enabled (i.e., with delay generator 220 enabled).

Axis 310 of timing diagram 300 corresponds to time. Awaveform 312 is a waveform of signal line 192, FIG. 4. A first trigger pulse 314 of waveform 312 corresponds to the operation of a Q-switched laser (not shown) while generating ions (e.g., ions 140, FIG. 2). A waveform 316 is a waveform of signal line 196, FIG. 4, and high voltage lines 204 and 208, FIG. 2 and FIG. 4, respectively. Delay generator 194, FIG. 4, sends a leading edge of a second trigger pulse 318 of waveform 316 into signal line 196 after a delay time 330 from a leading edge of first trigger pulse 314 (i.e., ions are generated during first trigger pulse 314, and the ions are accelerated during second trigger pulse 318). As previously described, the leading edge of second trigger pulse 318 occurs at the acceleration time.

A horizontal axis 350 of display 340 corresponds to time in the same scale as time axis 310, beginning at the acceleration time. Values along axis 350 correspond to the time of flight of ion subsets through regions 106, 108, 150, 164 and 166 of FIGS. 2 and 3. A vertical axis 360 of display 340 corresponds to the number of ions per unit time ("lion counts") detected by ion detector 170 of FIG. 3. Display 340 corresponds to channel display 282 of FIG. 4 during the setup of TOF-MS 10 (i.e., with delay generator 220 of FIG. 4 disabled). Several peaks 362 and 364 correspond to the ion counts generated by various ion subsets (e.g., subsets 144, 146, and 148 of FIG. 2) striking ion detector 170.

A waveform 320 in timing diagram 300 is a waveform of high voltage line 230 of FIG. 3 and FIG. 4 when delay generator 220 is enabled, as described with respect to FIG. 4. A high voltage is normally applied to high voltage line 230, but a ground voltage (indicated by a level 322) is applied during a pulse 324. Controls on delay generator 220 determine timing of the leading edge of pulse 324; controls on high-voltage timing circuit 228 determine the duration of pulse 324. Two dashed lines 334 and 336 indicate the times of the leading and trailing edges of pulse 324, and surround a single peak 364 having a time of flight 332. A portion of waveform 320 that begins at the time of the leading edge of second trigger pulse 318 also corresponds to portion 284 of FIG. 4 when delay generator 220 is enabled.

Display 340' corresponds to channel display 282 of FIG. 4 during the operation of TOF-MS 10, assuming the same setup as timing diagram 300 and display 340, except that mass selection is enabled (i.e., delay generator 220 is enabled). Two axes 350' and 360' are time and ion count axes, respectively, and are scaled as in axes 350 and 360 of display 340. A peak 364' is the only peak remaining after the action of the EMS grid (i.e., EMS grid 162 of FIG. 3) eliminates the ion subsets corresponding to peaks 362 of display 340.

It is possible to use time-of-flight mass selection to select more than one ion subset arriving from an ion generator. FIG. 6 shows a timing diagram 400 and two oscilloscope displays 440, 440' demonstrating operation of the TOF-MS in another embodiment. In like manner as FIG. 5, display 440 is channel display 282 of FIG. 4 corresponding to part of the time interval shown in timing diagram 400. In timing diagram 400, a horizontal axis 410 corresponds to time. A waveform 412 is a waveform of signal line 192 of FIG. 4. A first trigger pulse 414 of waveform 412 corresponds to the operation of a Q-switched laser (not shown) which generates ions 140 in FIG. 2. A waveform 416 is a waveform of signal line 196 of FIG. 4 and high voltage lines 204 and 208 of FIG. 2 and FIG. 4. Delay generator 194 of FIG. 4 sends a leading edge of a second trigger pulse 418 of waveform 416 into signal line 196 of FIG. 4, after a delay (not shown) from a leading edge of pulse first trigger pulse 414.

An axis 450 of display 440 corresponds to time, in the same scale as time axis 410, and beginning at the leading edge of second trigger pulse 418 of waveform 416 (i.e., at the acceleration time), as shown. Values along axis 450 correspond to the time of flight of ion subsets through regions 150, 164 and 166 of FIGS. 2 and 3. A vertical axis 460 of display 440 corresponds to the ion counts detected by ion detector 170 of FIG. 3. Display 440 corresponds to channel display 282 of FIG. 4 during the setup of TOF-MS 10, (i.e., with delay generator 220 of FIG. 4 disabled). Several peaks 462 and 464 correspond to the ion counts generated by various ion subsets (e.g., subsets 144, 146 and 148 of FIG. 2) striking ion detector 170.

A waveform 420 in timing diagram 400 is a waveform of high voltage line 230 of FIG. 3 and FIG. 4 when delay generator 220 is enabled, as described with respect to FIG. 4. In FIG. 6, delay generator 220 is configured to supply three trigger pulses 424, 426 and 428, each of which is delayed relative to second trigger pulse 418 by time periods that an operator of the TOF-MS may adjust. (The operator of the TOF-MS may also adjust the number of pulses, e.g., pulses 424, 426 and 428; three pulses are shown for illustration only). A high voltage is normally applied to high voltage line 230, but a ground voltage (indicated by level 422) is applied during each of pulses 424, 426 and 428. Dashed lines correspond to the times of the leading and trailing edges of trigger pulses 424, 426 and 428, and each pair of dashed lines surrounds a corresponding peak 464. A portion of waveform 420 that begins at the acceleration time corresponds to portion 284 of oscilloscope display 280 when delay generator 220 is enabled.

Display 440' corresponds to channel display 282 of FIG. 4 during the operation of a TOF-MS, assuming the same setup as timing diagram 400 and display 440, except that mass selection is enabled (i.e., delay generator 220 is enabled). Two axes 450' and 460' are time and ion count axes, respectively, and are scaled identically as axes 450 and 460 of display 440. Three peaks 464' are the only peaks remaining after the action of the EMS grid (i.e., EMS grid 162 of FIG. 3) eliminates the ion subsets corresponding to peaks 462 of display 440.

The ability of a TOF-MS with an EMS to isolate more than one subset of ions of identical mass simultaneously may confer certain advantages. For instance, depositions may be tailored to create specific combinations of elements, clusters or structures that are otherwise difficult to achieve by other methods (e.g., due to the difficulty of chemical isolation techniques). Such depositions may also include specific isotopes and exclude other isotopes. Other applications, involving detection rather than deposition, may include analysis of effluents or detection of the presence of a particular threat molecule in a mixed gas stream. For example, the EMS can be set to pass ions of the threat molecule as well as ionized fragments of the threat molecule, to detect the presence of a particular molecule in a flow of mixed gases.

The operating principle of a TOF-MS EMS, as described, may be used in other manipulations of ion subsets. For example, referring to detector end 16 in FIG. 3, when high voltage line 230 and EMS grid 162 are at ground, ions 38 continue moving in the direction of arrow 154 with the kinetic energy they received in ion generator 14 of TOF-MS 10. The kinetic energy of ions 38 may be sufficient to damage certain substrates 174 and/or materials deposited thereon.

Figure 7:
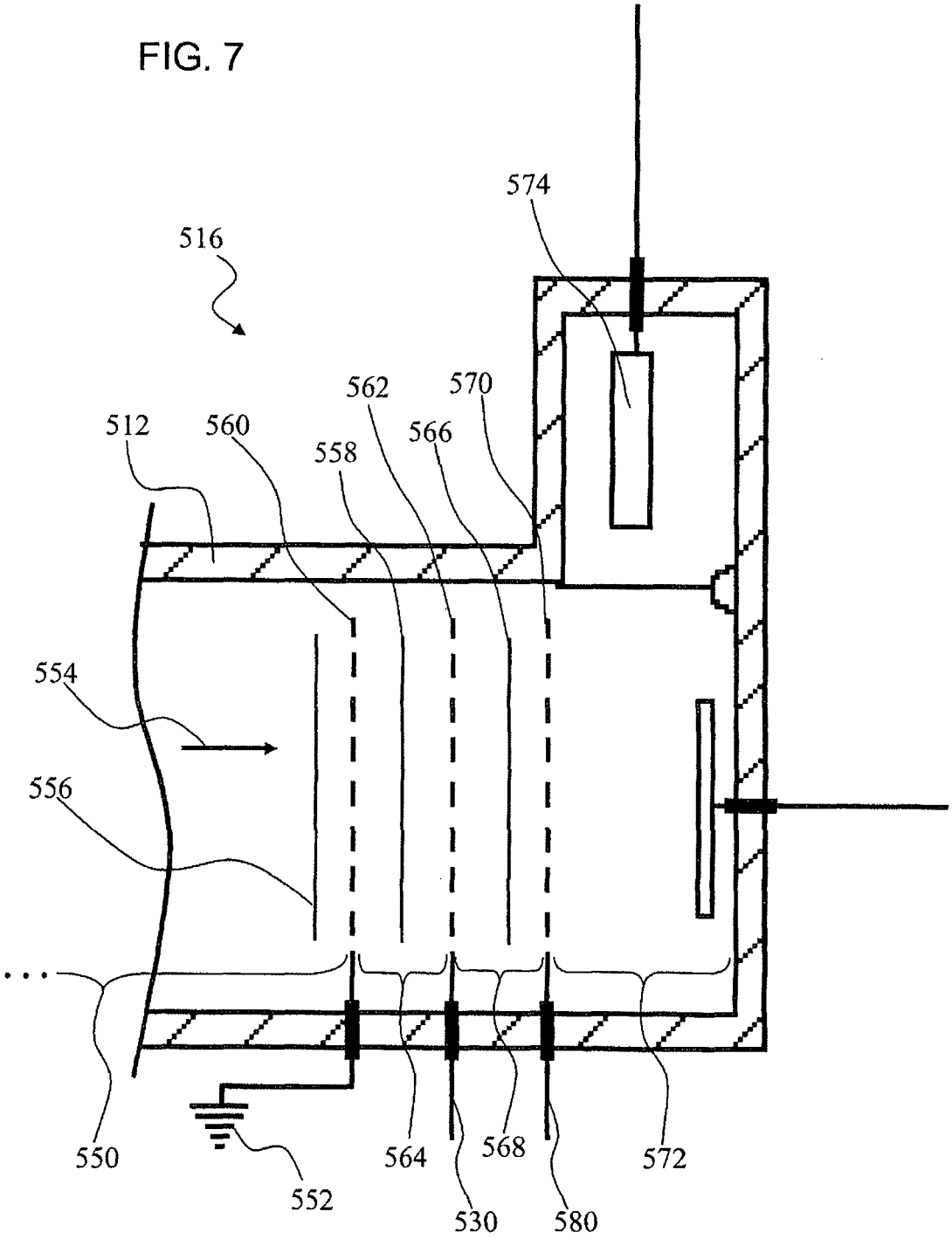
FIG. 7 shows exemplary detail of another detector end of an electronic time-of-flight mass selector and time-of-flight mass spectrometer.

FIG. 7 shows exemplary detail of another embodiment of an EMS within detector end 516 of a TOF-MS. An ion subset 556, with kinetic energy from an ion generator (not shown) of a TOF-MS, moves within a vacuum chamber 512 in the direction of arrow 554, through a drift region 550. As subset 556 moves through a ground grid 560 connected to a ground 552, it becomes subset 558 in a region 564. A high voltage line 530 and an EMS grid 562 correspond to high voltage line 230 and EMS grid 162 of FIG. 3, respectively. A high voltage HV3 may be applied to EMS grid 562, turning back nonselected ion subsets, and a low voltage may be selectively applied to EMS grid 562, allowing a selected ion subset 566 to pass. When a voltage HV4 connected with a high voltage line 580 provides an energy less than the kinetic energy of ions in selected ion subset 566 in a region 568, a deceleration grid 570 slows down selected ion subset 566. Deceleration grid 570 thus reduces kinetic energy of selected ion subset 566 reaching a substrate 574 (when positioned in a region 572), thereby minimizing damage to substrate 574 and/or the deposited material.

In other embodiments of an EMS, substrate potential modifies the kinetic energy of ions deposited thereon. For depositions onto conductive substrates, a power supply may connect electrically with a substrate through a substrate holder (e.g., substrate holder 176). A voltage connected with the substrate may be adjusted to a voltage lower than the kinetic energy of approaching ions, causing deceleration of the approaching ions in the same manner as deceleration grid 570 of FIG. 7 discussed above.

The type of ion source is not critical to implementation of an EMS within a TOF-MS. Any ion source capable of (1) introducing a group of ions within an extraction region of a vacuum chamber (e.g., extraction region 106 of ion generator 14) and (2) coupling with a suitable pulse generator to create a time reference for ion acceleration and time of flight timing, may be used. For example, a spark ion source (such as a pulsed arc cluster ion source) or an electro-spray ion source (to produce charged forms of proteins) is suitable.

Figure 8:
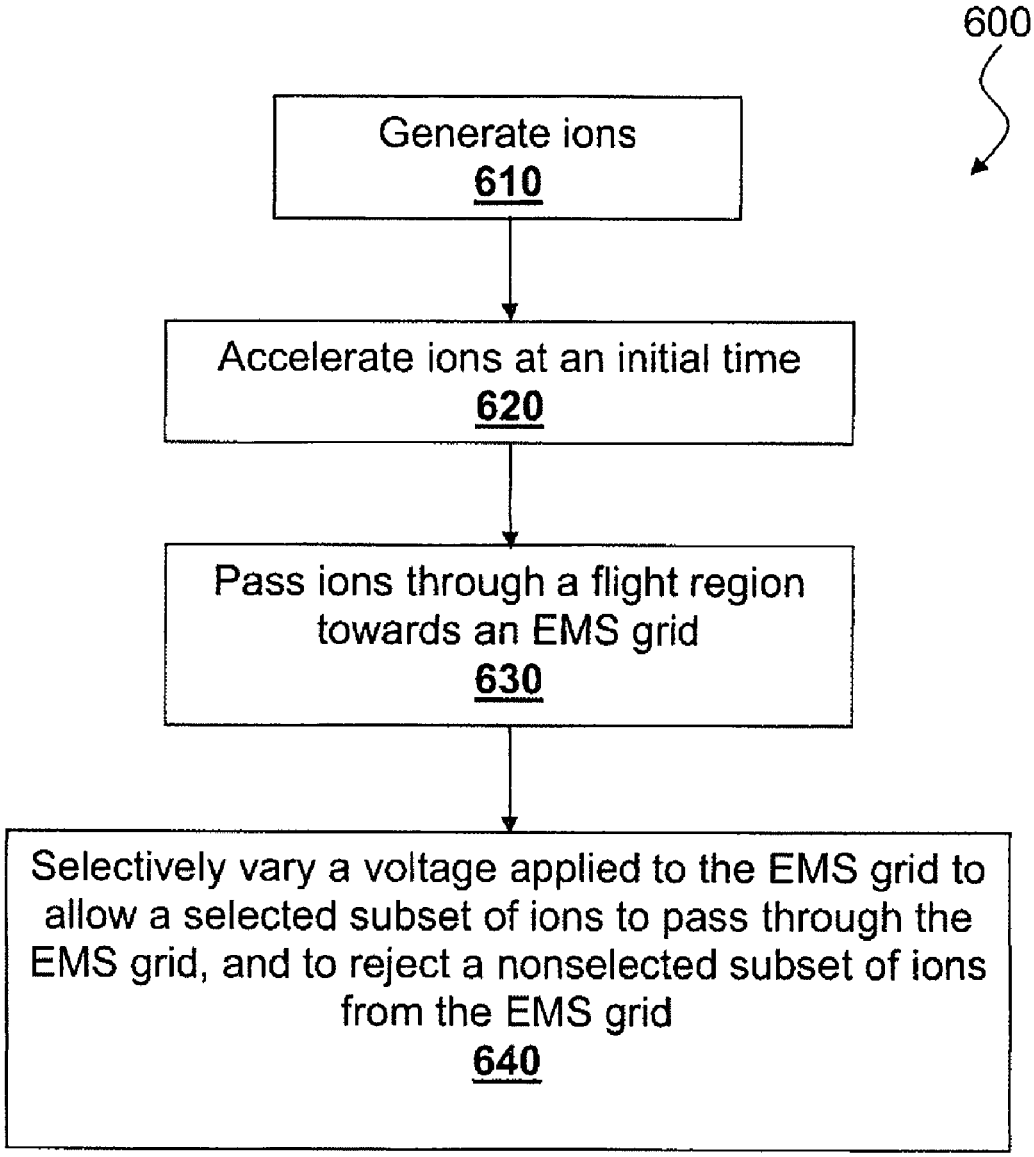
FIG. 8 shows a method of selecting ions.

FIG. 8 shows a method 600 of selecting ions in accordance with one embodiment. Step 610 generates a group of ions (e.g., during first trigger pulse 314 as shown in FIG. 5). Step 620 accelerates the group of ions at an acceleration time (e.g., starting at the leading edge of second trigger pulse 318 as shown in FIG. 5). Step 630 passes the group of ions through a flight region (e.g., drift region 150 as shown in FIG. 2 and FIG. 3) towards an EMS grid (e.g., EMS grid 162 of FIG. 3). Step 640 selectively varies a voltage applied to the EMS grid, thereby allowing a selected subset of ions to pass through the EMS grid, and turning back a nonselected subset of ions from the EMS grid. Alternative embodiments of this method include depositing the selected subset of ions on a substrate (e.g., substrate 174 of FIG. 3) and, alternatively, varying the voltage applied to the EMS grid more at least twice (e.g., during pulses 424, 426 and 428 of FIG. 6). Embodiments which include decelerating a selected subset of ions include (a) decelerating the selected subset of ions by maintaining a substrate at a voltage greater than ground but less than a kinetic energy of the ions and/or (b) passing the selected subset of ions through a deceleration grid (e.g., deceleration grid 570 as shown in FIG. 7) maintained at a voltage less than the kinetic energy of the ions.

The changes described above, and others, may be made in the electronic mass selector described herein without departing from the scope hereof. For example, although the descriptions and drawings herein use positive ions for illustrative purposes, voltage polarity changes enable operation with negative ions. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

What is claimed is:

1. A method of selecting ions, comprising:

generating a group of ions;

accelerating the group of ions through a flight region towards an electronic mass selector grid;

selectively varying a voltage applied to the electronic mass selector grid, wherein only a selected subset of the group of ions passes through the electronic mass selector grid; and depositing the selected subset of ions on a substrate.

2. The method of claim 1, further comprising maintaining the substrate at a voltage that decelerates the subset of ions.

3. The method of claim 1, the step of selectively varying a voltage comprising varying the voltage at least twice, wherein the subset of ions comprises at least two selected subsets of ions.

4. A method of selecting ions, comprising:

generating a group of ions;

accelerating the group of ions through a flight region towards an electronic mass selector grid; and selectively varying a voltage applied to the electronic mass selector grid, wherein only a selected subset of the group of ions passes through the electronic mass selector grid;

displaying time of flight information for subsets of the group of ions, and utilizing the time of flight information to space-focus the subsets by adjusting one or more voltages used in the step of accelerating.

5. The method of claim 1, further comprising decelerating the selected subset of ions through a deceleration grid maintained at a voltage less than a kinetic energy of the subset of ions.

6. Apparatus for selecting ions, comprising:

an ion generator;

an ion accelerator for accelerating ions into a flight region;

an electronic mass selector grid responsive to applied voltage to pass only a selected subset of the ions from the flight region; and a substrate holder for positioning a substrate to deposit the subset of the ions thereon.

7. Apparatus of claim 6, the substrate holder adapted to maintain the substrate at a voltage.

8. Apparatus of claim 6, further comprising a load lock for the substrate holder.

9. Apparatus of claim 6, further comprising electronics operable to vary the applied voltage.

10. Apparatus of claim 9, the electronics operable to vary the applied voltage to pass ions, of the subset, with two or more masses.

11. Apparatus for selecting ions, comprising:

an ion generator;

an ion accelerator for accelerating ions into a flight region, the ion accelerator comprising a backing plate and an extraction grid, the backing plate having a potential that is raised, at an acceleration time, to a first high voltage, the extraction grid having a potential that is raised, at the acceleration time, to an acceleration voltage that is greater than a ground voltage and less than the first high voltage, the acceleration voltage being adjustable for space-focusing of ion subsets; and an electronic mass selector grid, responsive to applied voltage to pass only a subset of the ions from the flight region.

12. Apparatus of claim 6, further comprising an ion detector and a display operable to display time of flight of ion subsets from the ion generator to the ion detector.

13. Apparatus of claim 6, further comprising a deceleration grid.

14. Apparatus of claim 6, the ion accelerator operable to accelerate positive ions into the flight region.

15. Apparatus of claim 6, the ion accelerator operable to accelerate negative ions into the flight region.

16. Apparatus for detecting a threat molecule, comprising:

an ion generator for generating ions from a mixed gas stream;

an ion accelerator for accelerating the ions into a flight region; and an electronic mass selector grid responsive to applied voltage to pass only a subset of the ions from the flight region, the subset comprising ions of the threat molecule.

17. Apparatus of claim 16, the subset comprising ionized fragments of the threat molecule.

18. The method of claim 1, wherein the selected subset of ions consists of ions of identical mass.

19. The method of claim 2, the subset of ions forming a deposited material on the substrate, the voltage that decelerates the subset of ions being suitable to minimize damage to the deposited material.

20. The apparatus of claim 11, wherein the extraction grid couples with the backing plate through a potentiometer.

21. A method of selecting ions, comprising:

generating a group of ions;

accelerating the group of ions through a flight region towards an electronic mass selector grid;

maintaining a voltage applied to the electronic mass selector grid at a voltage sufficient to turn back nonselected ions; and selectively connecting the electronic mass selector grid to ground so as to pass only the selected subset through the electronic mass selector grid.

* * * * *

UNITED STATES PATENT AND TRADEMARK OFFICE

CERTIFICATE OF CORRECTION

PATENT NO. : 7,829,843 B2
APPLICATION NO. : 11/571860
DATED : November 9, 2010
INVENTOR(S) : Burnin et al.

It is certified that error appears in the above-identified patent and that said Letters Patent is hereby corrected as shown below:

Column 1, line 58, “generator an” should read --generator and an--;
Column 5, line 58, “Awaveform” should read --A waveform--;
Column 6, line 9, “lion counts” should read --ion counts--; line 57, “pulse first trigger” should read --first trigger--;
Column 8, line 39, “more at least” should read --at least--;

Signed and Sealed this
Third Day of May, 2011

David J. Kappos

David J. Kappos
*Director of the United States Patent and Trademark Office*